US009340950B2

(12) United States Patent
McWethy

(10) Patent No.: US 9,340,950 B2
(45) Date of Patent: May 17, 2016

(54) HYDRAULIC FLUID WARM-UP

(71) Applicant: Deere & Company, Moline, IL (US)

(72) Inventor: Erik W. McWethy, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 279 days.

(21) Appl. No.: 13/793,795

(22) Filed: Mar. 11, 2013

(65) Prior Publication Data

US 2014/0193230 A1 Jul. 10, 2014

Related U.S. Application Data

(60) Provisional application No. 61/750,172, filed on Jan. 8, 2013.

(51) Int. Cl.

| | |
|---|---|
| ***F01P 3/00*** | (2006.01) |
| ***E02F 3/43*** | (2006.01) |
| ***E02F 9/22*** | (2006.01) |
| ***F15B 21/04*** | (2006.01) |
| *F01P 3/20* | (2006.01) |
| *F01P 7/16* | (2006.01) |

(52) U.S. Cl.

CPC ..... *E02F 3/435* (2013.01); *E02F 9/226* (2013.01); *F15B 21/042* (2013.01); *F01P 3/20* (2013.01); *F01P 7/165* (2013.01); *F01P 2060/02* (2013.01); *F01P 2060/04* (2013.01); *F01P 2060/08* (2013.01); *F15B 2211/30505* (2013.01); *F15B 2211/41563* (2013.01); *F15B 2211/611* (2013.01); *F15B 2211/62* (2013.01); *F15B 2211/6343* (2013.01); *F15B 2211/851* (2013.01)

(58) Field of Classification Search

CPC ... F01P 7/165; F01P 2060/08; F01P 2060/02; F01P 3/20; F01P 2060/04

USPC ..... 123/41.29

See application file for complete search history.

(56) References Cited

U.S. PATENT DOCUMENTS

| | | | | |
|---|---|---|---|---|
| 4,838,756 | A | 6/1989 | Johnson et al. | |
| 7,261,068 | B1 | 8/2007 | Wantschik | |
| 7,481,287 | B2 | 1/2009 | Madson et al. | |
| 7,806,091 | B2 | 10/2010 | Esau et al. | |
| 2003/0049023 | A1 * | 3/2003 | Schmitz | 388/825 |
| 2003/0221339 | A1 * | 12/2003 | Naruse et al. | 37/348 |
| 2007/0244841 | A1 * | 10/2007 | Vatchkov | E02F 9/26 706/16 |
| 2008/0279638 | A1 * | 11/2008 | Hoess | 405/274 |
| 2011/0232615 | A1 * | 9/2011 | Perr et al. | 123/568.26 |

FOREIGN PATENT DOCUMENTS

JP 0914215 A * 1/1997 ..... E02F 9/22

OTHER PUBLICATIONS

Dean Pump RA Series Air Cooled Thermal Liquid/Hot Oil Pumps, 2015, Metro Global Pump Solutions, p. 1.*

Deere, 755 Crawler Loader, available online at http://www.deere.com/en_US/docs/construction/non_current_products/crawler_loaders/755.pdf at least as early as Jan. 3, 2013, dated Mar. 24, 1997, 2 pages.

* cited by examiner

*Primary Examiner* — Lindsay Low
*Assistant Examiner* — Charles Brauch

(57) ABSTRACT

A work vehicle including a hydraulic circuit having a cooled return line with a cooler, a bypass return line that bypasses the cooler on the cooled return line, and a controller that electronically controls the flow of hydraulic fluid between the cooled return line and the bypass return line.

21 Claims, 4 Drawing Sheets

HYDRAULIC FLUID WARM-UP

CROSS-REFERENCE TO RELATED APPLICATION

This application claims priority from U.S. Provisional Patent Application Ser. No. 61/750,172, filed Jan. 8, 2013, the disclosure of which is hereby expressly incorporated by reference herein in its entirety.

FIELD

The present disclosure relates to a hydraulic system of a work vehicle. More particularly, the present disclosure relates to a hydraulic system that promotes improved warm-up of hydraulic fluid in a work vehicle, and to a method for using the same.

BACKGROUND

During the initial start-up and operation of a work vehicle, hydraulic fluid in the work vehicle may be relatively cold, especially when the work vehicle is operating in a cold climate. The cold hydraulic fluid may be viscous, which may reduce the response of hydraulic functions of the work vehicle, reduce hydraulic efficiency due to higher pressure drops in the work vehicle, and cause problems with power control of the work vehicle, for example.

When the cold hydraulic fluid eventually warms up to a normal operating temperature and becomes less viscous, the work vehicle may function and react properly. The work vehicle may include one or more coolers to maintain the hydraulic fluid at its normal operating temperature. However, during the initial start-up and operation of the work vehicle, such coolers may increase the time required for the cold hydraulic fluid to warm up to its normal operating temperature. The time required for the cold hydraulic fluid to warm up may be especially long when the work vehicle uses a fixed fan drive system that lacks the ability to reduce the cooling effect of the cooler, for example.

Prior attempts to improve the warm-up of hydraulic fluid in a work vehicle require additional equipment, such as thermostat-based flow control valves, which may be expensive and time-consuming to install.

SUMMARY

The present disclosure provides a work vehicle including a hydraulic circuit having a cooled return line branch with a cooler, a bypass return line branch that bypasses the cooler on the cooled return line branch, and a controller that electronically controls the flow of hydraulic fluid between the cooled return line branch and the bypass return line branch.

According to an embodiment of the present disclosure, a work vehicle is provided including a chassis, at least one traction device supporting the chassis, at least one hydraulic actuator coupled to the chassis, and a hydraulic circuit configured to operate the at least one hydraulic actuator. The hydraulic circuit includes a source of hydraulic fluid, a delivery device in fluid communication with the source and with at least one flow control valve which, in turn, is in fluid communication with the at least one hydraulic actuator to deliver hydraulic fluid to the at least one hydraulic actuator, a branched return line extending from the at least one hydraulic actuator to the source, the first return line including a first return line branch containing a flow control valve and a cooler, the first flow control valve allowing hydraulic fluid to travel along the first return line branch when a pressure in the hydraulic circuit exceeds a first cracking pressure of the first flow control valve, the return line further including a second return line branch extending to the source that bypasses the cooler on the first return line branch, the second return line branch including a second flow control valve, the second flow control valve allowing hydraulic fluid to travel along the second return line branch when the pressure in the hydraulic circuit exceeds a second cracking pressure of the second flow control valve, and a controller in communication with at least one of the first and second flow control valves to adjust at least one of the first and second cracking pressures.

According to another embodiment of the present disclosure, a work vehicle is provided including a chassis, at least one traction device supporting the chassis, at least one hydraulic actuator coupled to the chassis, and a hydraulic circuit configured to operate the at least one hydraulic actuator. The hydraulic circuit includes a source of hydraulic fluid, a delivery device in fluid communication with the source and with the at least one hydraulic actuator by way of a flow control valve to deliver the hydraulic fluid to the at least one hydraulic actuator, a branched return line extending from the at least one hydraulic actuator the source, the branched return line comprising a first return line branch including a cooler, a second return line extending from the at least one hydraulic actuator to the source, and a controller that electronically adjusts the hydraulic circuit between a cooling mode, wherein the second return line branch is restricted more than the first return line branch to direct the hydraulic fluid through the cooler on the first return line branch, and a bypass mode, wherein the first return line branch is restricted more than the second return line branch to direct the hydraulic fluid through the second return line branch while bypassing the cooler on the first return line branch.

According to yet another embodiment of the present disclosure, a method is provided for operating a work vehicle. The work vehicle includes a chassis and at least one hydraulic actuator coupled to the chassis. The method includes the steps of: directing hydraulic fluid from a source to the at least one hydraulic actuator; returning the hydraulic fluid from the at least one hydraulic actuator to the source via at least one of a first return line branch that includes a cooler and a second return line branch; and electrically controlling a restriction controlling arrangement configured for restricting the first return line branch relative to the second return line branch to direct the hydraulic fluid through the second return line branch while bypassing the cooler on the first return line branch.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
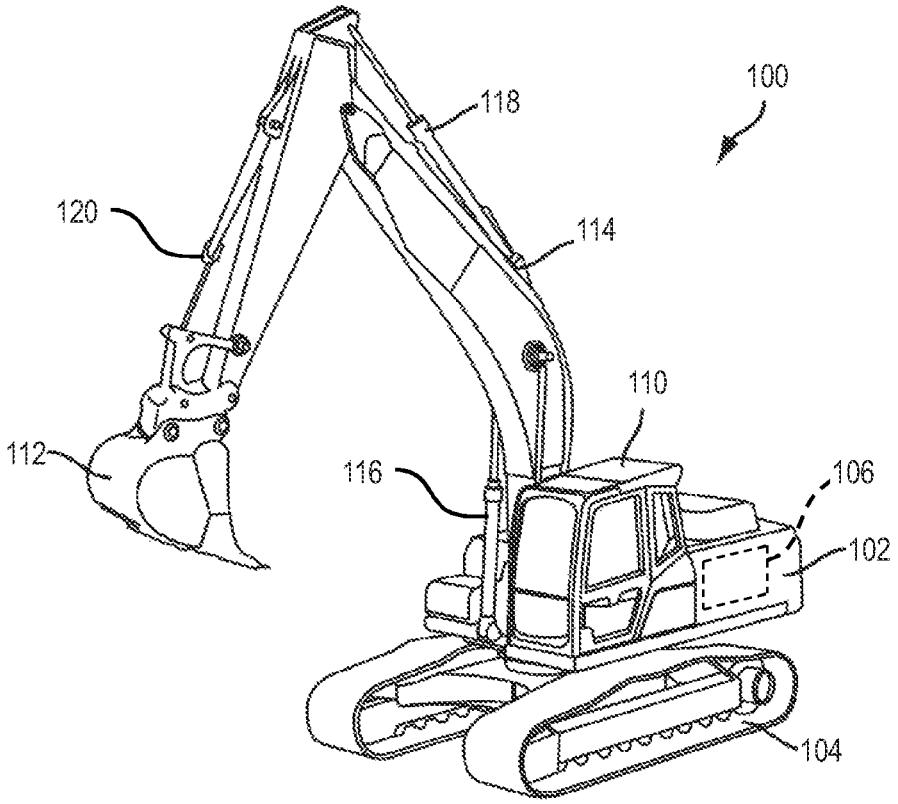
FIG. 1 is a perspective view of an exemplary excavator of the present disclosure.

Referring initially to FIG. 1, a work vehicle 100 is provided in the form of an excavator. Although vehicle 100 is illustrated and described herein as an excavator, vehicle 100 may also be in the form of a loader, a bulldozer, a motor grader, or another construction, agricultural, or utility vehicle, for example.

Vehicle 100 includes chassis 102. At least one traction device 104, illustratively a plurality of tracks, is provided to support chassis 102 on the ground. Although fraction devices 104 are in the form of tracks in FIG. 1, it is also within the scope of the present disclosure that traction devices 104 may be in the form of wheels, for example. Vehicle 100 also includes an engine 106 that communicates with traction devices 104 to propel chassis 102 across the ground.

Vehicle 100 further includes an operator cab 110 supported by chassis 102 to house and protect the operator of vehicle 100. Operator cab 110 may include a seat and various controls or user inputs for operating vehicle 100.

Vehicle 100 further includes at least one work tool, illustratively a front-mounted bucket 112. Bucket 112 is moveably coupled to chassis 102 via boom assembly 114 for scooping, carrying, and dumping dirt and other materials. Other suitable work tools include, for example, blades, forks, tillers, and mowers. A plurality of hydraulic cylinders 116, 118, 120 are also provided to achieve movement of bucket 112 and/or boom assembly 114 relative to chassis 102.

Figure 2:
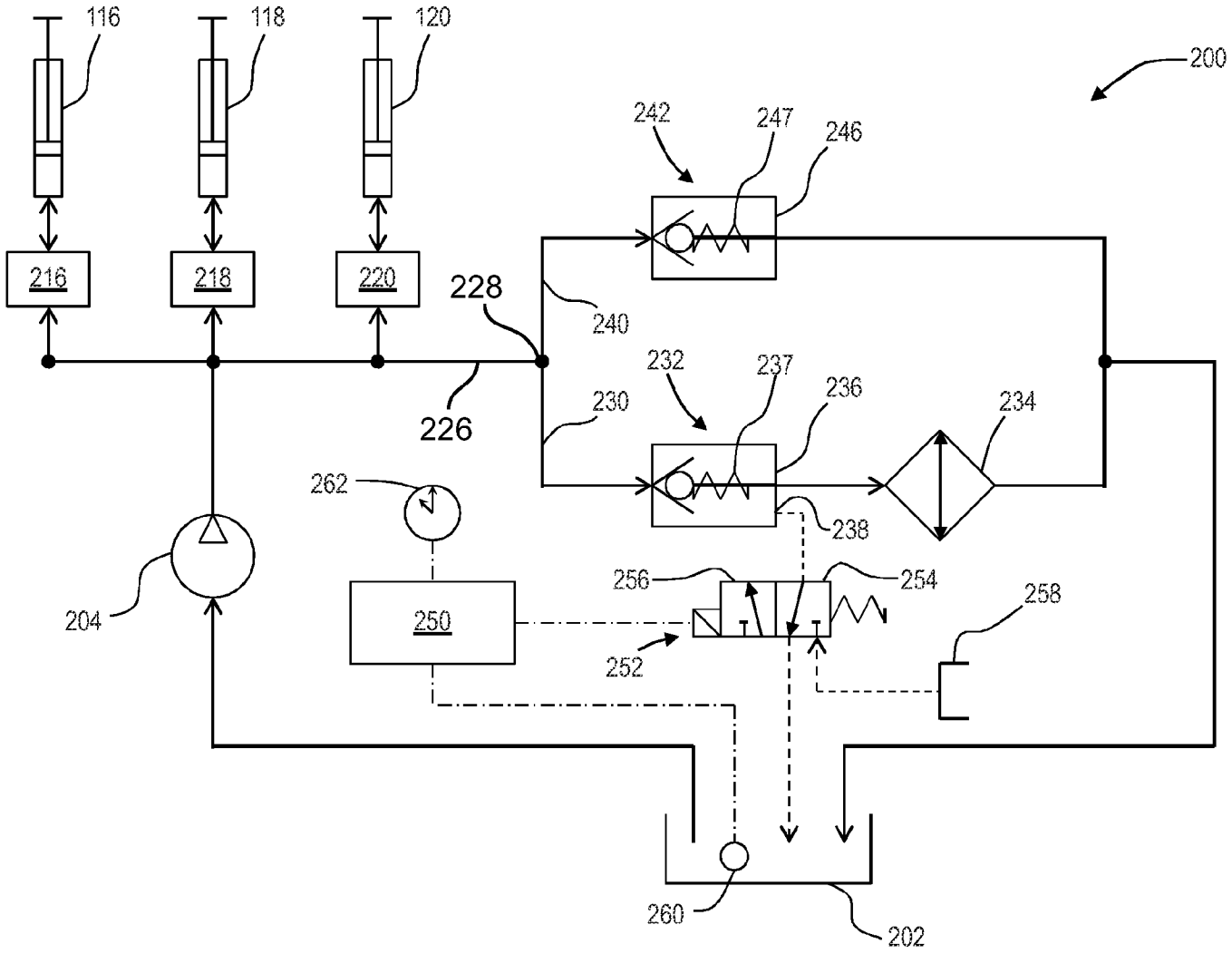
FIG. 2 is a schematic view of an exemplary hydraulic circuit for operating the excavator of FIG. 1.

Referring next to FIG. 2, a hydraulic circuit 200 is provided for operating vehicle 100. The illustrative hydraulic circuit 200 of FIG. 2 includes a reservoir 202 of hydraulic fluid (e.g., oil), at least one pump 204, and a plurality of flow control valves 216, 218, 220 in fluid communication with hydraulic cylinders 116, 118, 120, respectively. In operation, pump 204 directs hydraulic fluid from source 202 to hydraulic cylinders 116, 118, 120 via flow control valves 216, 218, 220 to move bucket 112 and/or boom assembly 114 relative to chassis 102 (FIG. 1). Hydraulic circuit 200 may also direct hydraulic fluid to hydraulic motors (not shown) and/or other hydraulic actuators other than hydraulic cylinders 116, 118, 120 to perform other hydraulic functions of vehicle 100.

The illustrative hydraulic circuit 200 of FIG. 2 further includes a branched return fluid line 226 connected to each of the flow control valves 216, 218 and 220 and branched at a junction 228 into a first or cooled return line branch 230 connected to reservoir 202 and a second or bypass return line branch 240 connected to reservoir 202. The cooled return line branch 230 includes a first flow control valve, illustratively a first check valve 232, as well as a cooler 234 (e.g., an air-cooled radiator) positioned downstream of the first check valve 232 and upstream of reservoir 202. The bypass return line branch 240 includes a second flow control valve, illustratively a second check valve 242, positioned upstream of reservoir 202. However, the bypass return line branch 240 lacks a cooler like the cooled return line branch 230. The first and second check valves 232, 242 create back pressure in hydraulic circuit 200 for improved control and performance. The first and second check valves 232, 242 also control the return flow of hydraulic fluid to reservoir 202, as discussed further below. Although the first and second flow control valves 232, 242 are shown and described herein as check valves, other types of flow control devices, such as pressure relief valves, orifices, or combinations thereof, may also be used to control the flow of hydraulic fluid along the cooled return line branch 230 and the bypass return line branch 240.

The first check valve 232 of the cooled return line branch 230 has a relatively low cracking pressure (i.e., the minimum upstream pressure required to open the first check valve 232) in normal operation. The pressure required to open the first check valve 232 may also be referred to herein as a "passage pressure" of the first check valve 232. The first check valve 232 includes a spring cavity 236 with an external vent 238. The cracking pressure of the first check valve 232 is determined by a spring 237 in spring cavity 236. In normal operation, vent 238 releases pressure in spring cavity 236 to ensure that high pressure is not trapped inside spring cavity 236, which would increase the cracking pressure of the first check valve 232. The first check valve 232 is normally closed. When the back pressure in hydraulic circuit 200 at the junction 228 exceeds the predetermined cracking pressure of the first check valve 232, the first check valve 232 will open, allowing hydraulic fluid to return to reservoir 202 via the now-opened cooled return line branch 230. Before the hydraulic fluid in the cooled return line branch 230 reaches reservoir 202, the hydraulic fluid will undergo cooling in cooler 234.

The second check valve 242 of the bypass return line branch 240 has a relatively high cracking pressure (i.e., the minimum upstream pressure required to open the second check valve 242) in normal operation that exceeds the relatively low cracking pressure of the first check valve 232. The pressure required to open the second check valve 242 may also be referred to herein as a "passage pressure" of the second check valve 242. The second check valve 242 also includes a spring cavity 246. The cracking pressure of the second check valve 242 is determined by a spring 247 in spring cavity 246. The second check valve 242 is normally closed. When the back pressure in the return line branches 230 and 240 of the hydraulic circuit 200 is sufficiently high to exceed the predetermined cracking pressure of the second check valve 242, both the first and second check valves 232, 242 will open, causing the return flow of hydraulic fluid to divide between the cooled return line branch 230 and the bypass return line branch 240. As discussed above, the hydraulic fluid in the cooled return line branch 230 will undergo cooling in cooler 234. However, the hydraulic fluid in the bypass return line branch 240 will not undergo cooling in cooler 234. In other words, the hydraulic fluid in the bypass return line branch 240 will bypass cooler 234.

As discussed above, other types of flow control devices may be used instead of first and second check valves 232, 242 to control the flow of hydraulic fluid along the cooled return line branch 230 and the bypass return line branch 240. For example, pressure relief valves may be used to control the flow of hydraulic fluid along the cooled return line branch 230 and the bypass return line branch 240. In this embodiment, the "passage pressure" may be determined by the relief pressure of the pressure relief valves. As another example, orifices may be used to control the flow of hydraulic fluid along the cooled return line branch 230 and the bypass return line branch 240. In this embodiment, the "passage pressure" may be determined by the size and/or shape of the orifices.

To adjust the flow of hydraulic fluid between the cooled return line branch 230 and the bypass return line branch 240, the cracking pressure or "passage pressure" of at least one of the first and second check valves 232, 242 may be varied. In the illustrated embodiment of FIG. 2, the cracking pressure of the first check valve 232 is adjustable, but it is also within the scope of the present disclosure that the cracking pressure of the second check valve 242 may be adjustable.

According to an exemplary embodiment of the present disclosure, a controller 250 and a solenoid regulating valve 252 are provided to electronically adjust the cracking pressure of the first check valve 232, as shown in FIG. 2. Controller 250 is in electrical communication with regulating valve 252. Controller 250 may include a suitably programmed processor or computer that is capable of receiving data, processing data, and sending appropriate commands to regulating valve 252. In addition to controlling regulating valve 252, controller 250 may control other components of vehicle 100, such as engine 106 (FIG. 1). In certain embodiments, controller 250 may be in the form of an on-off switch.

The illustrative regulating valve 252 of FIG. 2 includes a first, neutral position 254 and a second, commanded position 256. Regulating valve 252 may be a two-position control valve or a proportional control valve that is capable of moving to a plurality of intermediate positions between the first and second positions 254, 256. Regulating valve 252 is positioned downstream of vent 238 from spring cavity 236 of the first check valve 232 and upstream of reservoir 202. When regulating valve 252 is in the first position 254, regulating valve 252 allows pressure in spring cavity 236 of the first check valve 232 to escape to reservoir 202, which prevents back pressure in spring cavity 236 from affecting the cracking pressure of the first check valve 232. When controller 250 moves regulating valve 252 to the second position 256, on the other hand, regulating valve 252 closes the pressure escape path from vent 238 of spring cavity 236, and instead directs pilot pressure from pilot source 258, reservoir 202, or another suitable source into spring cavity 236. The added pilot pressure increases the pressure inside spring cavity 236, which forces the first check valve 232 closed and increases the cracking pressure required to open the first check valve 232.

Controller 250 may automatically operate regulating valve 252 based on one or more parameters of vehicle 100. One such parameter is the temperature of the hydraulic fluid in hydraulic circuit 200. A single thermocouple 260 is provided in reservoir 202 in FIG. 2 to measure the temperature of the hydraulic fluid in hydraulic circuit 200 and to communicate the measured temperature to controller 250. The position and number of thermocouples 260 in hydraulic circuit 200 may vary. For example, one or more thermocouples 260 may be positioned downstream of pump 204, downstream of flow control valves 216, 218, 220, or in other suitable locations of hydraulic circuit 200. Another such parameter is the warm-up time of vehicle 100. A timer 262 is provided in FIG. 2 to measure the operating time since the last start-up of vehicle 100 and to communicate the operating time to controller 250. The ability for controller 250 to electronically control regulating valve 252 provides flexibility in defining the parameters that will operate regulating valve 252. For example, the operator of each individual vehicle 100 may define a desired temperature input from thermocouple 260 and/or a desired warm-up time input from timer 262 that will cause controller 250 to operate regulating valve 252. Controller 250 may also operate regulating valve 252 based on a manual input from the operator of vehicle 100. The manual input may be delivered to controller 250 via a button (not shown) or another suitable user input located inside operator cab 110 of vehicle 100, for example.

By adjusting the relationship between the cracking pressures of the first and second check valves 232, 242, controller 250 may control the flow of hydraulic fluid between the corresponding cooled return line branch 230 and bypass return line branch 240. For example, by increasing the cracking pressure of the first check valve 232 to significantly exceed the cracking pressure of the second check valve 242, the controller 250 may force the first check valve 232 on the cooled return line branch 230 closed, thereby forcing all or a majority of the hydraulic fluid to travel through the bypass return line branch 240 via the second check valve 242. Controller 250 may be described as operating hydraulic circuit 200 in a "bypass mode" when the cooled return line branch 230 is closed or more restricted than the bypass return line branch 240. Then, by allowing the cracking pressure of the first check valve 232 to return to its normal state below the cracking pressure of the second check valve 242, controller 250 may allow the first check valve 232 on the cooled return line branch 230 to open, thereby encouraging the hydraulic fluid to travel through the cooled return line branch 230 via the first check valve 232. Controller 250 may be described as operating hydraulic circuit 200 in a "cooling mode" when the bypass return line branch 240 is closed or more restricted than the cooled return line branch 230.

As discussed above, it is also within the scope of the present disclosure that the cracking pressure of the second check valve 242 may be adjustable. Such adjustments to the second check valve 242 may be made instead of, or in addition to, adjustments to the first check valve 232. For example, controller 250 and regulating valve 252 may reduce the cracking pressure of the second check valve 242 below the cracking pressure of the first check valve 232, thereby forcing all or a majority of the hydraulic fluid to travel through the bypass return line branch 240 via the second check valve 242. Then, by allowing the cracking pressure of the second check valve 242 to return to its normal state above the cracking pressure of the first check valve 232, controller 250 may encourage the hydraulic fluid to travel through the cooled return line branch 230 via the first check valve 232.

Because the cooled return line branch 230 includes cooler 234 and the bypass return line branch 240 lacks a cooler in FIG. 2, controller 250 may also control cooling of the hydraulic fluid as it returns to reservoir 202. In general, controller 250 may achieve more cooling by directing more of the hydraulic fluid through the cooled return line branch 230 and its corresponding cooler 234, and controller 250 may achieve less cooling by directing more of the hydraulic fluid through the bypass return line branch 240 while bypassing cooler 234. In the previous example, where the first check valve 232 on the cooled return line branch 230 is forced closed, all or a majority of the hydraulic fluid would avoid being cooled by cooler 234. Then, when the first check valve 232 on the cooled return line branch 230 is allowed to open, more of the hydraulic fluid would undergo cooling in cooler 234.

Together, controller 250, regulating valve 252, and the first check valve 232 of FIG. 2 behave like a thermostat-controlled flow control valve, allowing hydraulic circuit 200 to control the flow of hydraulic fluid through cooler 234. The illustrative hydraulic circuit 200 achieves such temperature control while taking advantage of some existing and cost-effective vehicle components and plumbing.

Figure 2A:
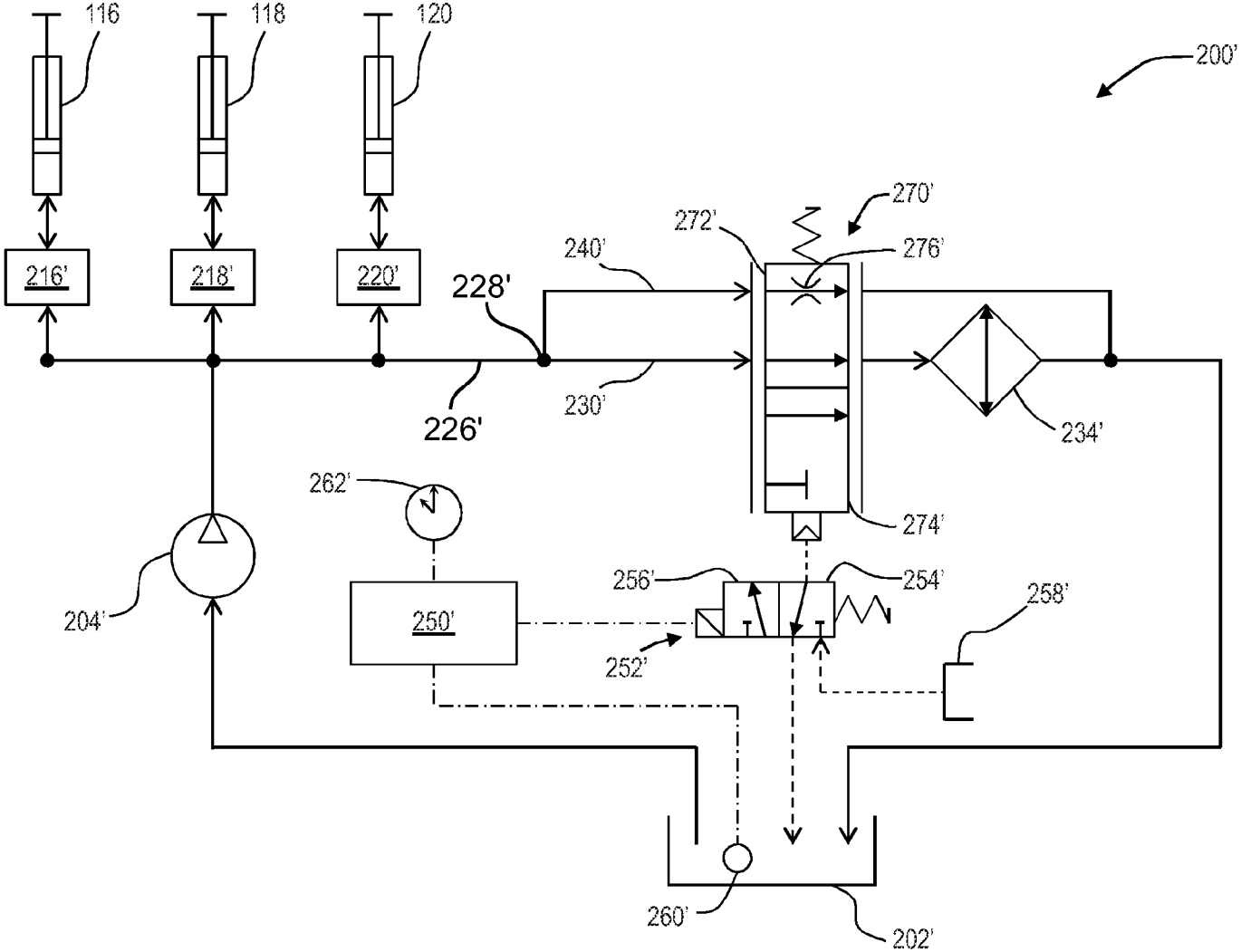
FIG. 2A is a schematic view of another exemplary hydraulic circuit for operating the excavator of FIG. 1.

Another hydraulic circuit 200' is shown in FIG. 2A for operating vehicle 100. Hydraulic circuit 200' is similar to hydraulic circuit 200, with like reference numerals indicating like elements, except as discussed below. In FIG. 2A, a branched return fluid line 226' is connected to each of the flow control valves 216', 218' and 220' and is branched at a junction 228' into a cooling return line branch 230' and a bypass return line branch 240' and the first and second flow control devices of the first embodiment are combined into a single pilot-operated spool valve 270'. It is also within the scope of the present disclosure that spool valve 270' may be operated electrically.

The illustrative spool valve 270' of FIG. 2A includes a first, neutral position 272', which is a normal position to which the spool valve is biased, and a second, commanded position 274'. Spool valve 270' may be a two-position control valve or a proportional control valve that is capable of moving to a plurality of intermediate positions between the first and second positions 272', 274'. When spool valve 270' is in the normal, first position 272', bypass return line branch 240' is restricted by orifice 276' to force all or a majority of the hydraulic fluid to travel through the unrestricted cooled return line branch 230' in a "cooling mode". When the spool valve 270' is in this normal position, a solenoid-operated regulating valve 252' is located in a normal, de-energized first position wherein it relieves pilot pressure from the spool valve 270'. When controller 250' is operated to energize the regulating valve 252', the regulating valve shifts to couple a source of pilot fluid 258' to the spool valve 270' to shift spool valve 270' to the second position 274' wherein the bypass return line branch 240' becomes unrestricted while the cooled return line branch 230' becomes restricted or blocked to force all or a majority of the hydraulic fluid to travel through the now-unrestricted bypass cooled return line branch 240' in a "bypass mode".

Figure 3:
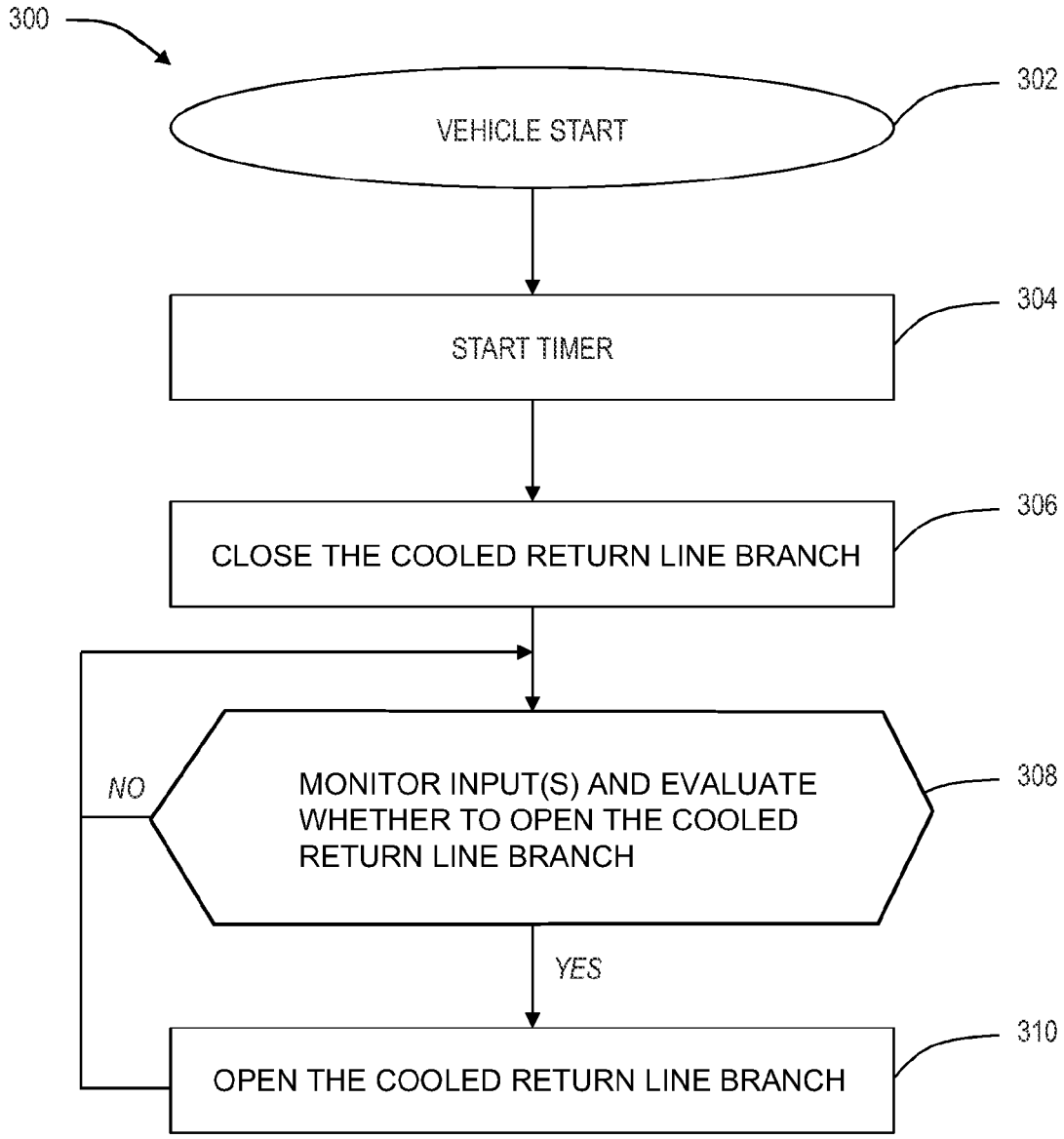
FIG. 3 is a flow chart of an exemplary method for operating the excavator of FIG. 1.

Referring next to FIG. 3, an exemplary method 300 is provided for operating controller 250 of FIG. 2. Vehicle 100 is powered on in step 302, which causes controller 250 to start timer 262 in step 304.

In step 306, controller 250 forces the first check valve 232 on the cooled return line branch 230 closed, ensuring that all or a majority of the hydraulic fluid initially travels along the bypass return line branch 240 in a "bypass mode" to avoid being cooled by cooler 234. By avoiding or limiting cooling during the initial start-up and operation of vehicle 100, controller 250 may encourage cold or ambient hydraulic fluid to quickly warm up to a normal operating temperature. Stated differently, controller 250 may avoid unnecessary cooling of cold or ambient hydraulic fluid.

In step 308, controller 250 evaluates whether to open the first check valve 232 on the cooled return line branch 230, which may involve continuously and repeatedly monitoring thermocouple 260, timer 262, manual inputs from the operator of vehicle 100, and/or other inputs, for example.

Based on the evaluation step 308, controller 250 eventually opens the first check valve 232 on the cooled return line branch 230 in step 310, which causes the hydraulic fluid to undergo cooling in cooler 234 in a "cooling mode". Deciding to open the first check valve 232 in step 310 may involve receiving an input from thermocouple 260 that a predetermined temperature (e.g., 40° C., 50° C., or 60° C.) has been reached, receiving an input from timer 262 that a predetermined warm-up time (e.g., 15 minutes) has passed, and/or receiving a manual instruction from the operator of vehicle 100, for example.

In method 300, the initial closing of the first check valve 232 in step 306 and the subsequent opening of the first check valve 232 in step 310 may occur gradually or incrementally. For example, as controller 250 receives increasing temperature readings from thermocouple 260 over time, controller 250 may open the first check valve 232 further and further until all or a majority of the hydraulic fluid eventually travels along the cooled return line branch 230 to undergo cooling by cooler 234.

In a further step, controller 250 may evaluate whether to return to the "bypass mode" by forcing the first check valve 232 on the cooled return line branch 230 closed, ensuring that all or a majority of the hydraulic fluid travels along the bypass return line branch 240 to avoid being cooled by cooler 234. Deciding to close the first check valve 232 may involve receiving an input from thermocouple 260 that the hydraulic fluid has dropped below the predetermined temperature and/or receiving a manual instruction from the operator of vehicle 100, for example.

A similar method 300 may be performed to operate controller 250' of FIG. 2A. In step 306 of method 300, controller 250' energizes solenoid-operated regulating valve 252' causing it to shift into the second position wherein it routes pilot fluid to the spool valve 270' forcing the spool valve 270' into the second position 274', which restricts or blocks the cooled return line branch 230' and directs all or a majority of the hydraulic fluid along the bypass return line branch 240' in a "bypass mode" to avoid being cooled by cooler 234'. In step 310 of method 300, controller 250' de-energizes the regulative valve 252' which returns to the normal position wherein it relieves pilot fluid from the spool valve 270' which allows spool valve 270' to return to the first position 272', which restricts or blocks the bypass return line branch 240' via orifice 276' and directs all or a majority of the hydraulic fluid along the cooled return line branch 230' to undergo cooling in cooler 234' in a "cooling mode". As discussed above, deciding whether to shift spool valve 270' may involve receiving an input from thermocouple 260' that a predetermined temperature (e.g., 40° C., 50° C., or 60° C.) has been reached, receiving an input from timer 262' that a predetermined warm-up time (e.g., 15 minutes) has passed, and/or receiving a manual instruction from the operator of vehicle 100, for example.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A work vehicle including:

a chassis;

at least one traction device supporting the chassis;

at least one hydraulic actuator coupled to the chassis;

a hydraulic circuit configured to operate the at least one hydraulic actuator and to selectively effect initial warm-up of a source of hydraulic fluid, the hydraulic circuit including:

a source of hydraulic fluid;

a delivery device in fluid communication with the source of hydraulic fluid;

a flow control valve coupled in fluid communication with the delivery device and with the at least one hydraulic actuator and being operable to selectively deliver hydraulic fluid to, and to receive return fluid from, the at least one hydraulic actuator;

a return line coupled for receiving return fluid from the flow control valve and for returning the return fluid to the source of hydraulic fluid;

the return line being branched into a first return line branch and a second return line branch;

said first return line branch including a normally closed, pressure responsive first flow control device and a cooler connected in series with each other, the first flow control device allowing the hydraulic return fluid to travel along the first return line branch when a pressure in the first return line branch immediately upstream of the first control device exceeds a cracking pressure of the first flow control device;

said second return line branch bypassing the first flow control device and the cooler on the first return line branch, the second return line branch including a pressure responsive second flow control device, the second flow control device allowing the hydraulic fluid to travel along the second return line branch when the return fluid immediately upstream of the second flow control device exceeds a second cracking pressure of the second flow control device; and a controller in communication with at least one of the first and second flow control devices and being operable when cooling of the return fluid is not desired to adjust at least one of the first and second cracking pressures to cause the first cracking pressure to be relatively higher than the second cracking pressure so that the return fluid flows through the second return line branch to the hydraulic fluid source by way of the second flow control device and bypasses the first flow control device and the cooler.

2. The work vehicle of claim 1, wherein an electrically responsive regulating valve is in fluid communication with at least one of the first and second flow control devices and is operable for respectively effecting first and second conditions respectively routing a pilot pressure and from and to the at least one of the first and second flow control devices for respectively increasing and decreasing the cracking pressure of the at least one of the first and second flow control devices; and said controller being in electrical communication with the electrically responsive regulating valve for selectively energizing the electrically responsive regulating valve for establishing said first and second conditions in said at least one of the first and second flow control devices.

3. The work vehicle of claim 1, wherein the controller automatically adjusts at least one of the first and second cracking pressures to prevent the return flow from normally flowing through the cooler based on at least one of:

a temperature input representing a temperature of hydraulic fluid being supplied by the delivery device;

a time input representing the time elapsed since initially starting operation of the delivery device; and a manual input from an operator of the work vehicle including at least one of a predetermined temperature input and a predetermined warm-up time.

4. The work vehicle of claim 3, wherein the controller adjusts at least one of the first and second cracking pressures to:

direct the hydraulic return fluid along the first return line branch when the temperature input indicates that the hydraulic fluid is at or above the predetermined temperature; and direct the hydraulic fluid along the second return line branch when the temperature input indicates that the hydraulic fluid is below the predetermined temperature.

5. The work vehicle of claim 4, wherein the predetermined temperature is at least about 40° C.

6. The work vehicle of claim 1, wherein the first flow control device includes a first check valve having the first cracking pressure, and the second flow control device includes a second check valve having the second cracking pressure.

7. The work vehicle of claim 6, further including an electrically responsive regulating valve in electrical communication with the controller and in fluid communication with the first check valve, the regulating valve having:

a de-energized first, neutral position that allows pilot pressure to escape from the first check valve; and an energized second position that directs pilot pressure into the first check valve to increase the first cracking pressure of the first check valve.

8. The work vehicle of claim 7, wherein the regulating valve is a proportional valve that is adjustable to at least one energized, intermediate position between the first and second positions.

9. The work vehicle of claim 1, wherein the second cracking pressure of the second flow control device normally exceeds the first cracking pressure of the first flow control device, such that hydraulic return fluid normally travels through the first flow control device and the cooler on the first return line.

10. The work vehicle of claim 9, wherein, during initial operation of the work vehicle, the controller at least one of:

increases the first cracking pressure of the first flow control device above the second cracking pressure of the second flow control device; and decreases the second cracking pressure of the second flow control device below the first cracking pressure of the first flow control device;

wherein the hydraulic return fluid travels through the second flow control device on the second return line while bypassing the cooler on the first return line.

11. The work vehicle of claim 1, wherein:

the first flow control device includes at least one of a check valve, a pressure relief valve, and an orifice; and the second flow control device includes at least one of a check valve, a pressure relief valve, and an orifice.

12. The work vehicle of claim 1, wherein the controller comprises an on-off switch.

13. A work vehicle including:

a chassis;

at least one traction device supporting the chassis;

at least one hydraulic actuator coupled to the chassis;

at least one hydraulic control valve:

a hydraulic circuit configured to operate the at least one hydraulic actuator, the hydraulic circuit including:

a source of hydraulic fluid;

a delivery device in fluid communication with the source and with the at least one hydraulic control valve to deliver the hydraulic fluid to the at least one hydraulic actuator via the at least one hydraulic control valve;

a branched return line extending from the at least one control valve to the source, the branched return line comprising a first return line branch connected to the source and including a cooler;

a second return line branch connected to the source;

a restriction controlling arrangement associated with the first return line branch and with the second return line branch and including an electrically responsive device operable for adjusting a relative restriction to return fluid flow through the first and second return line branches; and an electronic controller being connected to said electrically responsive device for electronically adjusting said restriction controlling arrangement between:

a cooling mode, wherein the second return line branch is restricted more than the first return line branch to direct the hydraulic fluid through the cooler on the first return line branch; and a bypass mode, wherein the first return line branch is restricted more than the second return line branch to direct the hydraulic fluid through the second return line branch while bypassing the cooler on the first return line branch.

14. The work vehicle of claim 13, wherein the controller adjusts the restriction controlling arrangement based on at least one of:

a temperature input;

a time input; and a manual input from an operator of the work vehicle.

15. The work vehicle of claim 13, wherein the electrically responsive device is a regulating valve and the controller is in electrical communication with the regulating valve, and wherein the restriction controlling arrangement includes a pilot pressure responsive flow control device; and the regulating valve directs a pilot signal to the flow control device to adjust the relative restriction to flow through the first and second return line branches to switch between the cooling mode and the bypass mode.

16. The work vehicle of claim 14, wherein the controller adjusts the restriction controlling arrangement based on the temperature input; a predetermined temperature corresponding to a threshold temperature at which cooling of the return fluid is desired being input to the controller, with the controller adjusting the restriction controlling arrangement so as to establish the cooling mode when the hydraulic fluid is at or above the predetermined temperature, and so as to establish the bypass mode when the hydraulic fluid is below the predetermined temperature.

17. The work vehicle of claim 13, wherein the cooling mode is established when the electrically responsive device of the restriction controlling arrangement is de-energized and wherein the controller comprises an on-off switch.

18. The work vehicle of claim 13, wherein the at least one hydraulic actuator operates a work tool that is movably coupled to the chassis of the work vehicle.

19. A method of operating a work vehicle in a cold climate, the work vehicle including a chassis and equipped with a hydraulic system including a source of hydraulic fluid, a delivery device coupled between the source and a control valve for selectively coupling the source to, and receiving return fluid from at least one hydraulic actuator coupled to the chassis, with a branched return line being coupled for receiving return fluid from the control valve and including a first return line branch that includes a cooler and a second return line branch that bypasses the cooler in the first return line branch, the method including the steps of:

(a) energizing an electrically operable restricting arrangement at an initial start-up of the vehicle for restricting the first return line branch relative to the second return line branch to direct the returning hydraulic fluid through the second return line branch while bypassing the cooler on the first return line branch; and (b) establishing a condition of the electrically operable restricting arrangement, once the hydraulic fluid has warmed to a predetermined temperature, for restricting the second return line branch relative to the first return line branch so as to direct at least a portion of the returning hydraulic fluid through said first return line branch.

20. The method of claim 19, wherein the second return line is normally restricted relative to the first return line to direct the hydraulic fluid through the cooler on the first return line, and step (b) above is performed by de-energizing the electrically operable restricting arrangement.

21. The method of claim 19, wherein restricting the first return line relative to the second return line includes at least one of:

restricting the first return line; and opening the second return line.

* * * * *